US008511041B2

(12) United States Patent
Fransen

(10) Patent No.: US 8,511,041 B2
(45) Date of Patent: Aug. 20, 2013

(54) ASSEMBLY FOR THE TEMPORARY ATTACHMENT OF A VERTICAL MASONRY GUIDE TO THE INNER LEAF OF A CAVITY WALL

(75) Inventor: Janwillem Fransen, Westerhaar (NL)

(73) Assignee: Profileset B.V., Westerhaar-Vriezenveensewijk (NL)

( * ) Notice: Subject to any disclaimer, the term of this patent is extended or adjusted under 35 U.S.C. 154(b) by 0 days.

(21) Appl. No.: 13/258,873

(22) PCT Filed: Mar. 16, 2010

(86) PCT No.: PCT/NL2010/050136

§ 371 (c)(1), (2), (4) Date: Dec. 6, 2011

(87) PCT Pub. No.: WO2010/110656

PCT Pub. Date: Sep. 30, 2010

(65) Prior Publication Data

US 2012/0096806 A1 Apr. 26, 2012

(30) Foreign Application Priority Data

Mar. 26, 2009 (NL) ..... 2002668

(51) Int. Cl.
*E04F 21/00* (2006.01)
*B25D 5/00* (2006.01)

(52) U.S. Cl.
USPC ..... 52/749.13; 52/100; 52/379; 33/578; 33/645; 33/406

(58) Field of Classification Search
USPC ..... 52/749.13, 749.14, 749.15, 98, 100, 52/127.2, 379, 513; 33/406, 407, 408, 410, 33/578, 645, 613; 428/43; 248/220.1
See application file for complete search history.

(56) References Cited

U.S. PATENT DOCUMENTS

| | | | | | |
|---|---|---|---|---|---|
| 1,172,259 | A | * | 2/1916 | Crist | 248/220.1 |
| 2,503,098 | A | * | 4/1950 | Crocker | 33/410 |
| 2,672,691 | A | * | 3/1954 | Sears et al. | 33/406 |
| 2,832,143 | A | | 4/1958 | Davis | |
| 3,063,152 | A | | 11/1962 | Colbert | |
| 3,130,500 | A | * | 4/1964 | Bongiovanni | 33/406 |
| 4,640,491 | A | * | 2/1987 | Grist et al. | 249/219.2 |
| 4,889,310 | A | * | 12/1989 | Boeshart | 249/41 |
| 4,970,797 | A | * | 11/1990 | Sarasin | 33/494 |
| 4,995,167 | A | * | 2/1991 | Sanchez | 33/404 |
| 5,274,929 | A | * | 1/1994 | Tocci | 33/407 |
| D361,710 | S | * | 8/1995 | Boeshart | D8/354 |
| D436,018 | S | * | 1/2001 | Boeshart | D8/354 |
| 6,224,031 | B1 | * | 5/2001 | Boeshart | 249/214 |
| 6,256,962 | B1 | * | 7/2001 | Boeshart | 52/745.09 |
| 6,698,710 | B1 | * | 3/2004 | VanderWerf | 249/216 |
| 7,818,935 | B2 | * | 10/2010 | Velickovic | 52/426 |

* cited by examiner

*Primary Examiner* — Robert Canfield
*Assistant Examiner* — Babajide Demuren
(74) *Attorney, Agent, or Firm* — Bozicevic, Field & Francis LLP; Bret E. Field; Daniel G. Stoddard

(57) ABSTRACT

Assembly for temporarily attaching a vertical masonry guide to an inner leaf of a cavity wall during laying of the bricks of an outer leaf of a cavity wall, comprising an inner leaf attaching part for attaching the assembly to the inner leaf, a masonry guide attaching part for attaching the assembly to the masonry guide, and a connecting part for mutually connecting the inner leaf attaching part and the masonry guide attaching part.

13 Claims, 2 Drawing Sheets

Figure 1:
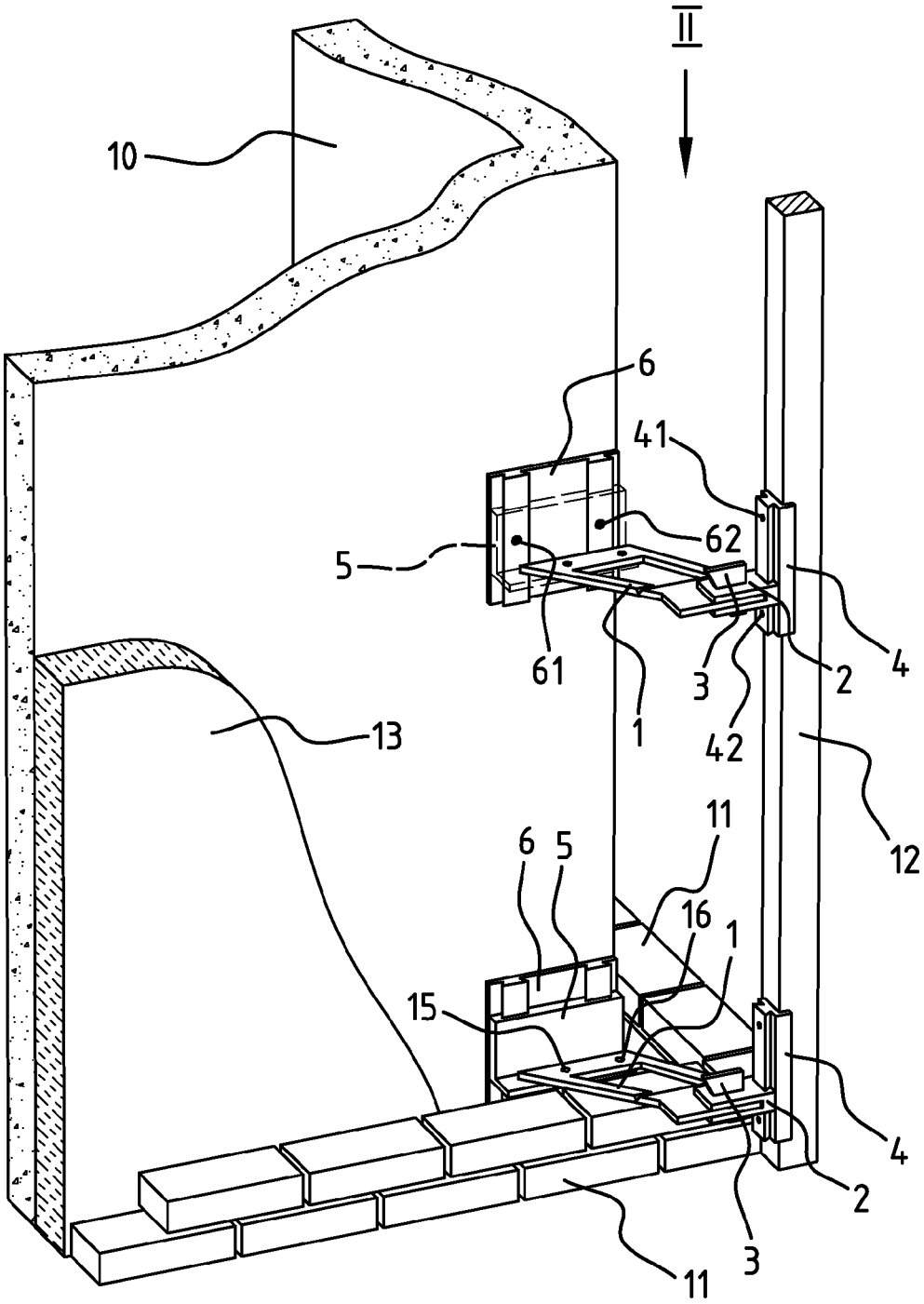

ASSEMBLY FOR THE TEMPORARY ATTACHMENT OF A VERTICAL MASONRY GUIDE TO THE INNER LEAF OF A CAVITY WALL

The invention relates to an assembly for temporarily attaching a vertical masonry guide to an inner leaf of a cavity wall during laying of the bricks of an outer leaf of a cavity wall.

During the laying of the outer leaf of a cavity wall by means of bricks and mortar wooden masonry guides (battens) are usually attached vertically to the inner leaf close to the corners. These masonry guides serve for level tensioning of horizontal wires along which the upper row of fresh bricks is laid. A known assembly for this purpose consists of several wooden battens and nails with which the masonry guide is fixed to the inner leaf. Arranging these masonry guides in this way is time-consuming. Long masonry guides are therefore used so that they do not, or less frequently, have to be adjusted in the height. The attaching means for the masonry guides also get in the way during the bricklaying.

The invention has for its object to provide an assembly with which the arranging and removal of the masonry guides becomes less time-consuming, with which material and waste can be saved, with which the bricklayer is impeded less during the bricklaying, a better quality of brickwork can be obtained and/or the bricklaying requires less time.

The assembly according to the invention comprises for this purpose an inner leaf attaching part for attaching the assembly to the inner leaf, a masonry guide attaching part for attaching the assembly to the masonry guide, and a connecting part for mutually connecting the inner leaf attaching part and the masonry guide attaching part. The inner leaf attaching part and the masonry guide attaching part are here preferably connected releasably to each other. The bricklayer can hereby first arrange the inner leaf attaching part on the inner leaf by means of nails or screws, and then arrange in simple manner the masonry guide attaching part co-acting therewith with the connecting part therebetween, and arrange the masonry guide thereon.

The inner leaf attaching part preferably comprises a support surface adapted to lie against the vertical inner leaf over a vertical distance of at least 3 cm, the masonry guide attaching part preferably comprises a support surface adapted to lie against the vertical masonry guide over a vertical distance of at least 3 cm, and the connecting part preferably has a joint bridging part with a length perpendicularly of the flat support surface of the inner attaching part of at least 7 cm where the thickness of the connecting part is a maximum of 1 cm. The joint bridging part is hereby no higher than a standard bed joint, whereby it can remain in place during bricklaying and will form part of the bed joint.

The inner leaf attaching part and the joint bridging part are preferably connected releasably to each other. The inner leaf attaching part and the joint bridging part are preferably also mutually connected for sliding relative to each other, wherein sliding is possible in the direction perpendicularly of the plane of the joint bridging part. The inner leaf attaching part and the joint bridging part are preferably also releasably connected to each other here by means of an inner leaf attaching slide part which forms on the one hand a slidable dovetail connection with the inner leaf attaching part and has on the other an engaging part on which the joint bridging part can be mounted, for instance by means of screws. It is hereby possible to mount the ,inner leaf attaching part with a margin at the correct location on the inner leaf, after which the joint bridging part can be displaced downward along the inner leaf attaching part onto the upper row of bricks.

The masonry guide attaching part and the joint bridging part are preferably also connected releasably to each other. The masonry guide attaching part and the joint bridging part are here preferably mutually connected for sliding relative to each other, wherein sliding is possible in the direction lying perpendicularly of the plane of the joint bridging part. The masonry guide attaching part and the joint bridging part are here preferably also connected releasably to each other by means of a masonry guide attaching slide part which forms on the one hand a slidable dovetail connection with the masonry guide attaching part and has on the other an engaging part on which the joint bridging part can be mounted, for instance by means of a wedge. It is hereby possible, once a lower and upper assembly have been arranged roughly at the correct location on the inner leaf and upper and lower masonry guide attaching parts have been mounted at roughly the correct location on the masonry guide, to slide the masonry guide in vertical direction in the masonry guide attaching slide parts. Once a row of bricks has been laid over the upper joint bridging part, the masonry guide can also be removed in simple manner by sliding it in vertical direction out of the masonry guide slide parts. The upper assembly is then used as lower assembly, and a new upper assembly is attached to the inner leaf, after which the masonry guide with the two masonry guide attaching parts is slid into these two assemblies. A relatively short masonry guide can hereby be used repeatedly as the brickwork of the outer leaf increases in height.

The joint bridging part preferably extends such that the line between the support surfaces of the inner leaf attaching part and the masonry guide attaching part extends at an angle of about 45 degrees to the support surface of the inner leaf attaching part, whereby the masonry guide can extend on the corners of the outer leaves.

The joint bridging part preferably has on the part with a thickness of a maximum of 1 cm a weakened portion close to the masonry guide attaching part such that it can be broken away with little force at this position along the weakened portion. Once it has been broken off, the broken surface of the joint bridging part disappears from sight during grouting of the outer leaf.

In the preferred method according to the invention the inner leaf attaching part is for instance fixed against the inner leaf by means of two drive plugs. The inner leaf attaching slide part is then slid by means of the dovetail connection over the inner leaf attaching part. The connecting part/joint bridging part is then connected, for instance by means of the wedge, to the masonry guide attaching slide part (and the first time also to the masonry guide attaching part pushed therein). This sub-assembly is then screwed onto the inner leaf attaching part, for which purpose the inner leaf attaching slide part is provided with two screw slots at a right angle to each other so that the sub-assembly can be set in the correct position for a vertical position of the masonry guide by means of sliding the screws in the screw slots. The masonry guide is subsequently fixed, for instance by means of screws, to the masonry guide attaching parts (on following occasions the masonry guide with the masonry guide attaching parts fixed thereto is slid simply into the masonry guide attaching slide parts). If the upper row of laid bricks is situated directly below a joint bridging part, the joint bridging part is slid downward until it rests on the upper row of laid bricks of the outer leaf, so that the joint bridging part can be laid in the bed joint below the following row of bricks.

The masonry guide with the masonry guide attaching parts fixed thereto is then removed vertically from the masonry guide attaching slide parts and used again in a following higher position. The lower masonry guide attaching slide part is removed from the connecting part/joint bridging part, for instance by knocking out the wedge. This masonry guide attaching slide part can in this way also be reused. The connecting part is broken off at the position of the joint bridging part.

Figure 2:
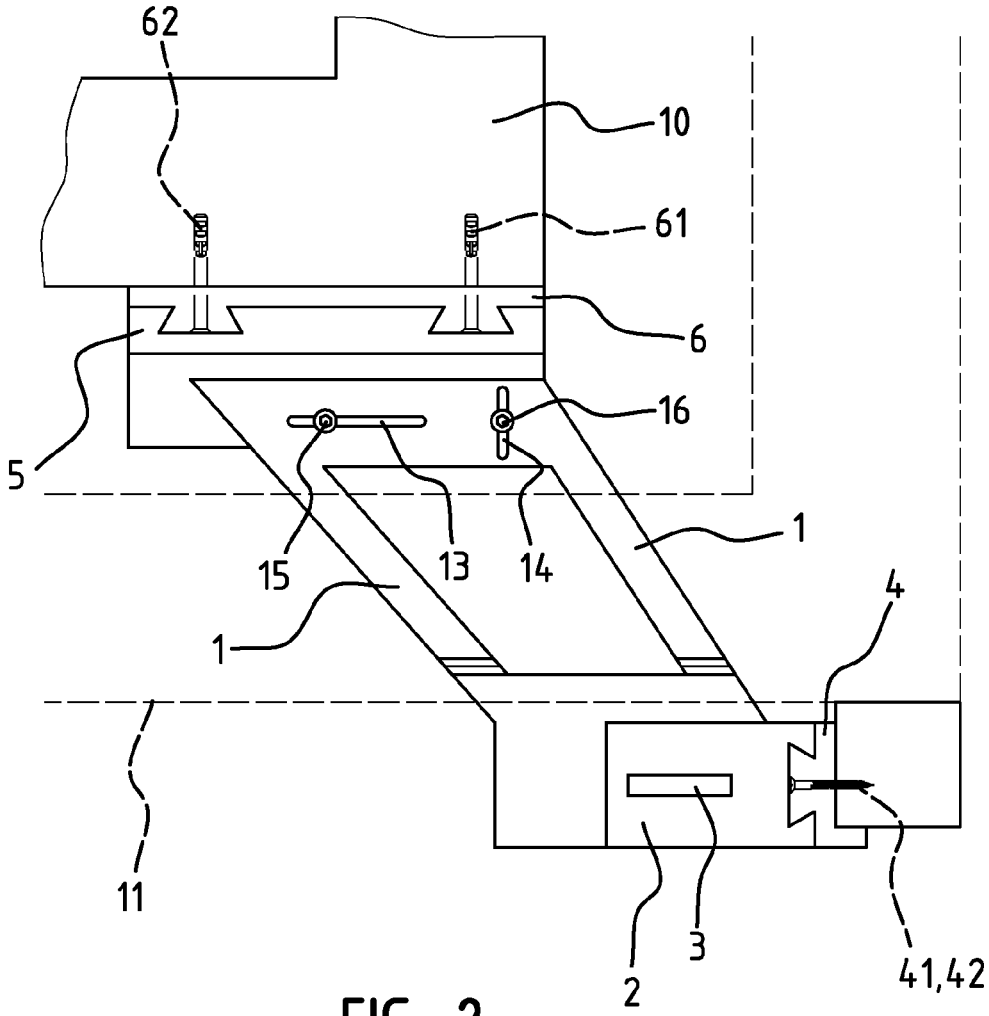

The invention will be further elucidated on the basis of an embodiment of the assembly shown in the figures, in which:

FIG. 1 is a perspective view of two assemblies according to the invention in the intended application; and FIG. 2 is a top view of an assembly according to the invention.

A cavity wall comprises an inner leaf 10, insulation material 13 and a brickwork outer leaf 11. According to the figures the assembly for attaching the vertical masonry guide 12 successively comprises, as seen from inner leaf 10, an inner leaf attaching part 6, an inner leaf attaching slide part 5, a connecting part/joint bridging part 1, a masonry guide attaching slide part 2 and a masonry guide attaching part 4. The vertical masonry guide 12 is mounted on the masonry guide attaching part 4 in the above described manner in order to enable laying of the bricks of outer leaf 11 of the cavity wall along a wire tensioned horizontally thereon.

The inner leaf attaching part 6 consists of a rectangular vertical plastic plate on one side of which are situated two protruding vertical dovetail tracks. Holes run through the dovetail tracks and the plate so that this part can be fixed by means of drive plugs 61, 62 against inner leaf 10.

The inner leaf attaching slide part 5 consists of an angular plastic plate with a vertical part and a horizontal part, with two dovetail grooves in the vertical part which can co-act with the dovetail tracks of the inner leaf attaching part 4. The horizontal part comprises two screw holes.

The connecting part/joint bridging part 1 consists of a plastic plate substantially in the form of a parallelogram, from which the middle part is cut away. The acute angle of the parallelogram is about 45 degrees. The thickness of the plate is a maximum of 1 cm. The plate is provided on one side with two screw slots 13, 14 at a right angle to each other so that this side can be fastened by means of screws 15, 16 in the screw holes of the horizontal part of inner leaf slide part 5 and can here be set in a correct position. On the opposite side the plate is provided with a slot-like hole for receiving wedge 3. The joint bridging part is provided with a weakened portion close to the outer side of the outer leaf so that it can be easily broken away at that position.

The masonry guide attaching slide part 2 comprises a plastic plate bent substantially in a U-shape. In the horizontal bent outer end of the plate is situated a vertical dovetail groove. Both legs of the U-shaped plate are provided with slot-like holes for receiving wedge 3. Connecting part 1 can slide in between the legs of masonry guide attaching slide part 2 and be secured by means of wedge 3.

The masonry guide attaching part 4 comprises a rectangular vertical plastic plate, on one side of which is situated a protruding vertical dovetail track. Screw holes run through the dovetail track and the plate so that this part can be fastened by means of screws 41, 42 against masonry guide 12. The plate is provided with a vertical bent edge so that it can easily be placed in the correct manner against masonry guide 12.

The invention claimed is:

1. Assembly for temporarily attaching a vertical masonry guide to an inner leaf of a cavity wall during laying of the bricks of an outer leaf of a cavity wall, comprising:

an inner leaf attaching part for attaching the assembly to the inner leaf;

a masonry guide attaching part for attaching the assembly to the masonry guide; and a connecting part for mutually connecting the inner leaf attaching part and the masonry guide attaching part, characterized in that the connecting part comprises a joint bridging part no higher than a bed joint that can remain in place during bricklaying and will form part of the bed joint, the masonry guide attaching part and the joint bridging part are connected releasably to each other, and the connecting part is provided with a weakened portion close to an outer side of the outer leaf so that it can be easily broken away at this position.

2. Assembly as claimed in claim 1, wherein the inner leaf attaching part comprises a support surface adapted to lie against the vertical inner leaf over a vertical distance of at least 3 cm.

3. Assembly as claimed in claim 1, wherein the masonry guide attaching part comprises a support surface adapted to lie against the vertical masonry guide over a vertical distance of at least 3 cm.

4. Assembly as claimed in claim 1, wherein the joint bridging part has a length perpendicularly of the flat support surface of the inner attaching part of at least 7 cm where the thickness of the connecting part is a maximum of 1 cm.

5. Assembly as claimed in claim 1, wherein the inner leaf attaching part and the joint bridging part are connected releasably to each other.

6. Assembly as claimed in claim 1, wherein the inner leaf attaching part and the joint bridging part are mutually connected for sliding relative to each other, wherein sliding is possible in the direction lying perpendicularly of the plane of the joint bridging part.

7. Assembly as claimed in claim 1, wherein the inner leaf attaching part and the joint bridging part are releasably connected to each other by means of an inner leaf attaching slide part which forms a slidable dovetail connection with the inner leaf attaching part and comprises an engaging part on which the joint bridging part can be mounted.

8. Assembly as claimed in claim 1, wherein the masonry guide attaching part and the joint bridging part are mutually connected for sliding relative to each other, wherein sliding is possible in the direction lying perpendicularly of the plane of the joint bridging part.

9. Assembly as claimed in claim 1, wherein the masonry guide attaching part and the joint bridging part are connected releasably to each other by means of a masonry guide attaching slide part.

10. Assembly as claimed in claim 9, wherein the masonry guide attaching slide part forms a slidable dovetail connection with the masonry guide attaching part and comprises an engaging part on which the joint bridging part can be mounted.

11. Assembly as claimed in claim 1, wherein the joint bridging part extends such that the line between the support surfaces of the inner leaf attaching part and the masonry guide attaching parts extends at an angle of about 45 degrees to the support surface of the inner leaf attaching part.

12. Assembly as claimed in claim 1, wherein the joint bridging part has on the part with a thickness of a maximum of 1 cm a weakened portion close to the masonry guide attaching part such that it can be broken away with little force at this position along the weakened portion.

13. Assembly as claimed in claim 1, wherein the weakened portion of the connecting part lies within the bed joint.

* * * * *